US010811803B2

(12) United States Patent
Pan et al.

(10) Patent No.: US 10,811,803 B2
(45) Date of Patent: Oct. 20, 2020

(54) CONNECTION TERMINAL

(71) Applicant: Tyco Electronics (Shanghai) Co. Ltd., Shanghai (CN)

(72) Inventors: Lei Pan, Shanghai (CN); Pai Rejendra, Bangalore (IN); Tongbao Ding, Shanghai (CN); Huigang Guo, Shanghai (CN); Xing Tong, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/351,968

(22) Filed: Mar. 13, 2019

(65) Prior Publication Data

US 2019/0288428 A1 Sep. 19, 2019

(30) Foreign Application Priority Data

Mar. 13, 2018 (CN) ..... 2018 2 0339835 U

(51) Int. Cl.
*H01R 13/20* (2006.01)
*H01R 13/115* (2006.01)
*H01R 4/18* (2006.01)

(52) U.S. Cl.
CPC ..... *H01R 13/20* (2013.01); *H01R 13/115* (2013.01); *H01R 4/185* (2013.01)

(58) Field of Classification Search
CPC ..... H01R 4/20; H01R 4/185; H01R 13/20; H01R 13/115
See application file for complete search history.

(56) References Cited

U.S. PATENT DOCUMENTS 2,945,206 A * 7/1960 Hammell ..... 439/881
3,123,431 A * 3/1964 Keller ..... H01R 4/185 439/881
3,577,119 A * 5/1971 Delyon ..... H01R 4/184 439/881
3,771,111 A * 11/1973 Pritulsky ..... H01R 13/115 439/850
4,298,243 A * 11/1981 Swengel, Jr. ..... H01R 13/115 439/730
4,421,375 A * 12/1983 Coldren ..... H01R 4/2462 439/423

(Continued)

*Primary Examiner* — Edwin A. Leon
*Assistant Examiner* — Milagros Jeancharles
(74) *Attorney, Agent, or Firm* — Barley Snyder

(57) ABSTRACT

A connection terminal comprises a receptacle portion, a wire crimping portion, and a connection portion. The receptacle portion includes a latching elastic sheet disposed at a rear end of the receptacle portion. The wire crimping portion includes a conductor crimping portion adapted to be crimped onto a conductor of the wire. The connection portion is connected between the rear end of the receptacle portion and the wire crimping portion and includes a first connection portion and a second connection portion. The conductor crimping portion and the latching elastic sheet are disposed between the first connection portion and the second connection portion and opposite to each other in the longitudinal direction. The first connection portion has a first bent portion and the second connection portion has a second bent portion. The first bent portion and the second bent portion each protrude in a height direction.

18 Claims, 1 Drawing Sheet

(56) References Cited

U.S. PATENT DOCUMENTS

| | | | | | |
|---|---|---|---|---|---|
| 4,679,887 | A * | 7/1987 | Jackson | H01R 13/20 | 439/849 |
| 6,086,433 | A * | 7/2000 | Hils | H01R 13/113 | 439/849 |
| 6,997,746 | B2 * | 2/2006 | Taylor | H01R 4/183 | 439/585 |
| 7,198,526 | B1 * | 4/2007 | MacNeil | H01R 4/185 | 439/881 |
| 9,692,163 | B1 * | 6/2017 | Didonato | H01R 4/70 | |
| 10,027,037 | B2 * | 7/2018 | Didonato | H01R 4/48 | |
| 10,079,440 | B1 * | 9/2018 | Didonato | H01R 4/48 | |
| 2006/0073743 | A1 * | 4/2006 | Ford | H01R 4/187 | 439/877 |
| 2014/0342621 | A1 * | 11/2014 | Omori | H01R 11/09 | 439/878 |

* cited by examiner

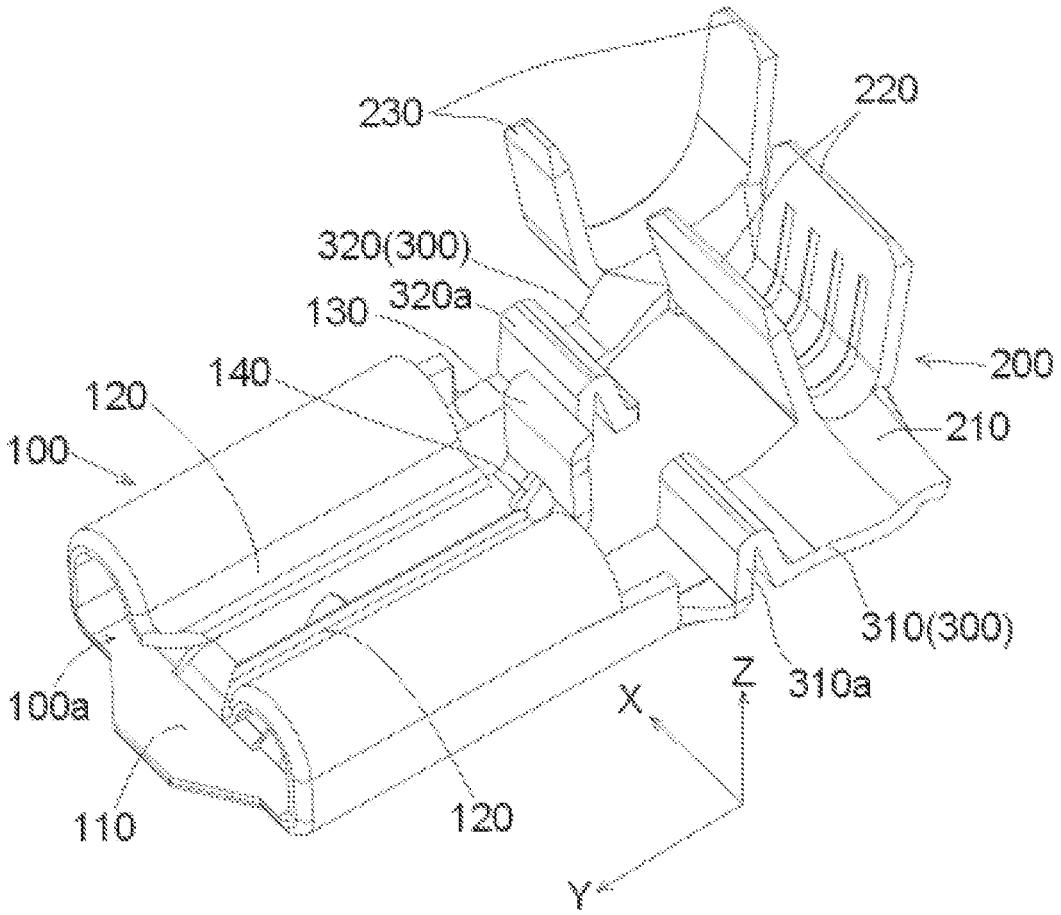
230
220
320(300)
320a
130
140
120
100
200
210
310(300)
310a
100a
110
120
X
Z
Y

CONNECTION TERMINAL

CROSS-REFERENCE TO RELATED APPLICATION

This application claims the benefit of the filing date under 35 U.S.C. § 119(a)-(d) of Chinese Patent Application No. 201820339835.3, filed on Mar. 13, 2018.

FIELD OF THE INVENTION

The present invention relates to a connection terminal and, more particularly, to a connection terminal with a receptacle portion and a wire crimping portion.

BACKGROUND

A connection terminal generally comprises a receptacle portion located at a first end of the connection terminal in a longitudinal direction, a wire crimping portion located at a second end of the connection terminal in the longitudinal direction, and a connection portion connected between the receptacle portion and the wire crimping portion. The receptacle portion of the connection terminal is adapted to be mated with a plug to be electrically connected therewith. The wire crimping portion of the connection terminal is adapted to be crimped onto a wire to be electrically connected therewith. The wire crimping portion of the connection terminal generally includes a conductor crimping portion adapted to be crimped onto a conductor of the wire and an outer cladding crimping portion adapted to be crimped onto an outer cladding of the wire. The receptacle portion includes a latching elastic sheet adapted to be latched onto the inserted plug and located at a rear end of the receptacle portion.

The conductor crimping portion of the wire crimping portion is usually disposed outside the receptacle portion in a lateral direction, so as to be offset from the latching elastic sheet of the receptacle portion, thereby preventing the conductor crimping portion from interfering with the latching elastic sheet. Such a design will not increase a size of the connection terminal in the longitudinal direction, but will increase the size of the connection terminal in the lateral direction, which is disadvantageous for miniaturizing the connection terminal.

SUMMARY

A connection terminal comprises a receptacle portion, a wire crimping portion, and a connection portion. The receptacle portion includes a latching elastic sheet disposed at a rear end of the receptacle portion. The wire crimping portion includes a conductor crimping portion adapted to be crimped onto a conductor of the wire. The connection portion is connected between the rear end of the receptacle portion and the wire crimping portion and includes a first connection portion and a second connection portion. The conductor crimping portion and the latching elastic sheet are disposed between the first connection portion and the second connection portion and opposite to each other in the longitudinal direction. The first connection portion has a first bent portion and the second connection portion has a second bent portion. The first bent portion and the second bent portion each protrude in a height direction.

BRIEF DESCRIPTION OF THE DRAWINGS

The invention will now be described by way of example with reference to the accompanying FIGURES, of which:

FIG. 1 is a perspective view of a connection terminal according to an embodiment.

DETAILED DESCRIPTION OF THE EMBODIMENT(S)

The technical solution of the disclosure will be described hereinafter in further detail with reference to the following embodiments, taken in conjunction with the accompanying drawings. In the specification, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

A connection terminal according to an embodiment, as shown in FIG. 1, comprises a receptacle portion 100, a wire crimping portion 200, and a connection portion 300. The receptacle portion 100 is located at a first end of the connection terminal in a longitudinal direction Y thereof and adapted to be mated with a plug inserted into the receptacle portion 100. The wire crimping portion 200 is located at a second end of the connection terminal in the longitudinal direction Y thereof and adapted to be crimped onto a wire. The connection portion 300 is connected between a rear end of the receptacle portion 100 and the wire crimping portion 200. In the embodiment shown in FIG. 1, the connection terminal is an integrated piece made of a single piece of metal sheet.

The wire crimping portion 200, as shown in FIG. 1, includes a conductor crimping portion 220 adapted to be crimped onto a conductor of the wire and an outer cladding crimping portion 230 adapted to be crimped onto an outer cladding of the wire. The receptacle portion 100 includes a latching elastic sheet 130 adapted to be latched onto the inserted plug. The latching elastic sheet 130 is located at the rear end of the receptacle portion 100.

The connection portion 300, as shown in FIG. 1, includes a first connection portion 310 and a second connection portion 320. The conductor crimping portion 220 and the latching elastic sheet 130 are disposed between the first connection portion 310 and the second connection portion 320 and opposite to each other in the longitudinal direction Y.

As shown in FIG. 1, the first connection portion 310 has a first bent portion 310*a* and the second connection portion 320 has a second bent portion 320*a*. The first bent portion 310*a* and the second bent portion 320*a* protrude in a height direction Z perpendicular to the longitudinal direction Y and a lateral direction X. In this way, it is possible to reduce the size of the first connection portion 310 and the second connection portion 320 in the longitudinal direction Y. The first connection portion 310 has a rear end connected to a first side of the conductor crimping portion 220 and a front end connected to a first side of the rear end of the receptacle portion 100. The second connection portion 320 has a rear end connected to a second side of the conductor crimping portion 220 and a front end connected to a second side of the rear end of the receptacle portion 100. The second connection portion 320 is disposed between the conductor crimping portion 220 and the outer cladding crimping portion 230 in the lateral direction X.

A longitudinal length of the connection portion 300 is relatively large to prevent the latching elastic sheet 130 and the conductor crimping portion 220 from interfering with each other during formation while also limiting a lateral X dimension of the connection terminal. In an embodiment, after the latching elastic sheet 130 and the conductor crimping portion 220 are formed, the connection portion 300 is bent, thereby shortening the size of the connection portion 300 in the longitudinal direction Y. Therefore, the longitudinal Y and the lateral X dimensions of the connection terminal are minimized, which contributes to miniaturization of the connection terminal.

The wire crimping portion 200, as shown in FIG. 1, includes a base 210 extending in the lateral direction X and adapted to connect the conductor crimping portion 220 and the outer cladding crimping portion 230. The conductor crimping portion 220 includes a pair of conductor crimping wings on a pair of opposite sides of the base 210, and the outer cladding crimping portion 230 includes a pair of outer cladding crimping wings on a pair of opposite sides of the base 210.

The receptacle portion 100, as shown in FIG. 1, includes a bottom wall portion 110 and a pair of elastic contact portions 120 adapted to be in an elastic and electrical contact with the inserted plug. An insertion cavity 100*a* is defined between the bottom wall portion 110 and the elastic contact portions 120 and adapted to receive the plug. The bottom wall portion 110 has a left side and a right side opposite to each other in the lateral direction X, and a front end and a rear end opposite to each other in the longitudinal direction Y. The pair of elastic contact portions 120 are respectively connected to the left and right sides of the bottom wall portion 110, and the latching elastic sheet 130 is connected to the rear end of the bottom wall portion 110. The insertion cavity 100*a* has a front opening at the front end of the bottom wall portion 110. The plug is adapted to be inserted into the insertion cavity 100*a* through the front opening in the longitudinal direction Y.

As shown in FIG. 1, the elastic contact portions 120 are each formed as an elastic contact sheet rolled into an arc shape from the left side and the right side of the bottom wall portion 110. The elastic contact sheet is adapted to be in elastic and electrical contact with a top surface of the inserted plug. The latching elastic sheet 130 has an elastic latch 140 protruding towards an interior of the insertion cavity 100*a*. The elastic latch 140 is adapted to be engaged into a notch formed in a front end surface of the inserted plug. The front end of the first connection portion 310 is connected to one of the left and the right sides of the bottom wall portion 110, and the front end of the second connection portion 320 is connected to the other side of the left and right sides of the bottom wall portion 110.

It should be appreciated by those skilled in this art that the above embodiments are intended to be illustrative, and many modifications may be made to the above embodiments by those skilled in this art, and various structures described in various embodiments may be freely combined with each other without conflicting in configuration or principle.

Although the disclosure have been described hereinbefore in detail with reference to the attached drawings, it should be appreciated that the disclosed embodiments in the attached drawings are intended to illustrate the preferred embodiments of the disclosure by way of example, and should not be construed as limitation to the disclosure.

Although several exemplary embodiments have been shown and described, it would be appreciated by those skilled in the art that various changes or modifications may be made to these embodiments without departing from the principles and spirit of the disclosure, the scope of which is defined by the claims and their equivalents.

What is claimed is:

1. A connection terminal, comprising:

a receptacle portion disposed at a first end of the connection terminal in a longitudinal direction and adapted to be mated with a plug, the receptacle portion includes a latching elastic sheet disposed at a rear end of the receptacle portion and adapted to be latched onto the plug;

a wire crimping portion disposed at a second end of the connection terminal in the longitudinal direction and adapted to be crimped onto a wire, the wire crimping portion includes a conductor crimping portion adapted to be crimped onto a conductor of the wire and an outer cladding crimping portion adapted to be crimped onto an outer cladding of the wire; and a connection portion connected between the rear end of the receptacle portion and the wire crimping portion, the connection portion includes a first connection portion and a second connection portion, the conductor crimping portion and the latching elastic sheet are disposed between the first connection portion and the second connection portion and are disposed opposite to each other in the longitudinal direction, the first connection portion has a first bent portion and the second connection portion has a second bent portion, the first bent portion and the second bent portion each protrude in a height direction perpendicular to the longitudinal direction and a lateral direction, the first bent portion and the second bent portion are positioned between and spaced apart from each of the rear end of the receptacle portion and the conductor crimping portion in the longitudinal direction.

2. The connection terminal of claim 1, wherein the first connection portion has a rear end connected to a first side of the conductor crimping portion and a front end connected to a first side of the rear end of the receptacle portion.

3. The connection terminal of claim 2, wherein the second connection portion has a rear end connected to a second side of the conductor crimping portion and a front end connected to a second side of the rear end of the receptacle portion.

4. The connection terminal of claim 3, wherein the second connection portion is disposed between the conductor crimping portion and the outer cladding crimping portion in the lateral direction.

5. The connection terminal of claim 4, wherein the wire crimping portion includes a base extending in the lateral direction and connecting the conductor crimping portion and the outer cladding crimping portion.

6. The connection terminal of claim 5, wherein the conductor crimping portion includes a pair of conductor crimping wings on a pair of opposite sides of the base.

7. The connection terminal of claim 6, wherein the outer cladding crimping portion includes a pair of outer cladding crimping wings on a pair of opposite sides of the base.

8. The connection terminal of claim 7, wherein the receptacle portion includes a bottom wall portion and a pair of elastic contact portions adapted to be in an elastic and electrical contact with the plug, an insertion cavity is defined between the bottom wall portion and the elastic contact portions and is adapted to receive the plug.

9. The connection terminal of claim 8, wherein the bottom wall portion has a left side and a right side opposite to each other in the lateral direction and a front end and a rear end opposite to each other in the longitudinal direction, the pair of elastic contact portions are connected to the left side and the right side of the bottom wall portion.

10. The connection terminal of claim 9, wherein the latching elastic sheet is connected to the rear end of the bottom wall portion.

11. The connection terminal of claim 10, wherein the insertion cavity has a front opening at the front end of the bottom wall portion, the plug is adapted to be inserted into the insertion cavity through the front opening in the longitudinal direction.

12. The connection terminal of claim 11, wherein each elastic contact portion has an elastic contact sheet rolled into an arc shape, the elastic contact sheet is adapted to be in elastic and electrical contact with a top surface of the plug.

13. The connection terminal of claim 11, wherein the latching elastic sheet has an elastic latch protruding towards an interior of the insertion cavity.

14. The connection terminal of claim 9, wherein the front end of the first connection portion is connected to one of the left side and the right side of the bottom wall portion, and the front end of the second connection portion is connected to the other of the left side and the right side of the bottom wall portion.

15. The connection terminal of claim 1, wherein the connection terminal is an integrated piece made of a single piece of metal sheet.

16. The connection terminal of claim 8, wherein the base is disposed in a same plane as the bottom wall portion.

17. The connection terminal of claim 16, wherein the receptacle portion receives the plug in the longitudinal direction.

18. The connection terminal of claim 17, wherein the wire crimping portion receives the wire in the lateral direction.

* * * * *